US008840201B2

(12) United States Patent
Garnett et al.

(10) Patent No.: US 8,840,201 B2
(45) Date of Patent: Sep. 23, 2014

(54) HEIGHT ADJUSTMENT MECHANISM FOR A RACK ASSEMBLY OF AN APPLIANCE

(75) Inventors: William Nathan Garnett, Ekron, KY (US); Daniel J. Hart, Louisville, KY (US)

(73) Assignee: General Electric Company, Schenectady, NY (US)

( * ) Notice: Subject to any disclaimer, the term of this patent is extended or adjusted under 35 U.S.C. 154(b) by 243 days.

(21) Appl. No.: 13/468,352

(22) Filed: May 10, 2012

(65) Prior Publication Data

US 2013/0300269 A1 Nov. 14, 2013

(51) Int. Cl.
*A47B 77/08* (2006.01)
*A47B 81/00* (2006.01)

(52) U.S. Cl.
USPC ..... 312/228.1

(58) Field of Classification Search
CPC ..... A47L 15/504
USPC ..... 312/228.1, 333.4; 211/41.8, 41.9; 134/135
See application file for complete search history.

(56) References Cited

U.S. PATENT DOCUMENTS

| | | | | |
|---|---|---|---|---|
| 5,657,878 | A * | 8/1997 | Austin | 211/41.8 |
| 7,410,228 | B2 | 8/2008 | Dickson et al. | |
| 7,775,378 | B2 * | 8/2010 | Tynes et al. | 211/41.8 |
| 2006/0119236 | A1 * | 6/2006 | Dickson et al. | 312/311 |
| 2011/0017890 | A1 * | 1/2011 | Ala | 248/235 |

FOREIGN PATENT DOCUMENTS

| | | | |
|---|---|---|---|
| EP | 1166708 | * | 1/2002 |

* cited by examiner

*Primary Examiner* — Darnell Jayne
*Assistant Examiner* — Timothy M Ayres
(74) *Attorney, Agent, or Firm* — Dority & Manning, P.A.

(57) ABSTRACT

A support mechanism for height adjustability of a rack assembly or other drawer-like feature of an appliance such as e.g., a dishwashing appliance is provided. The support mechanism includes a track for controlling the movement of the rack between different vertical levels. For certain embodiments, a user can adjust the height of the rack assembly by lifting and/or lowering the rack assembly directly and without a requirement of simultaneously depressing or squeezing the support mechanism or items thereon.

15 Claims, 8 Drawing Sheets

FIG. –1–

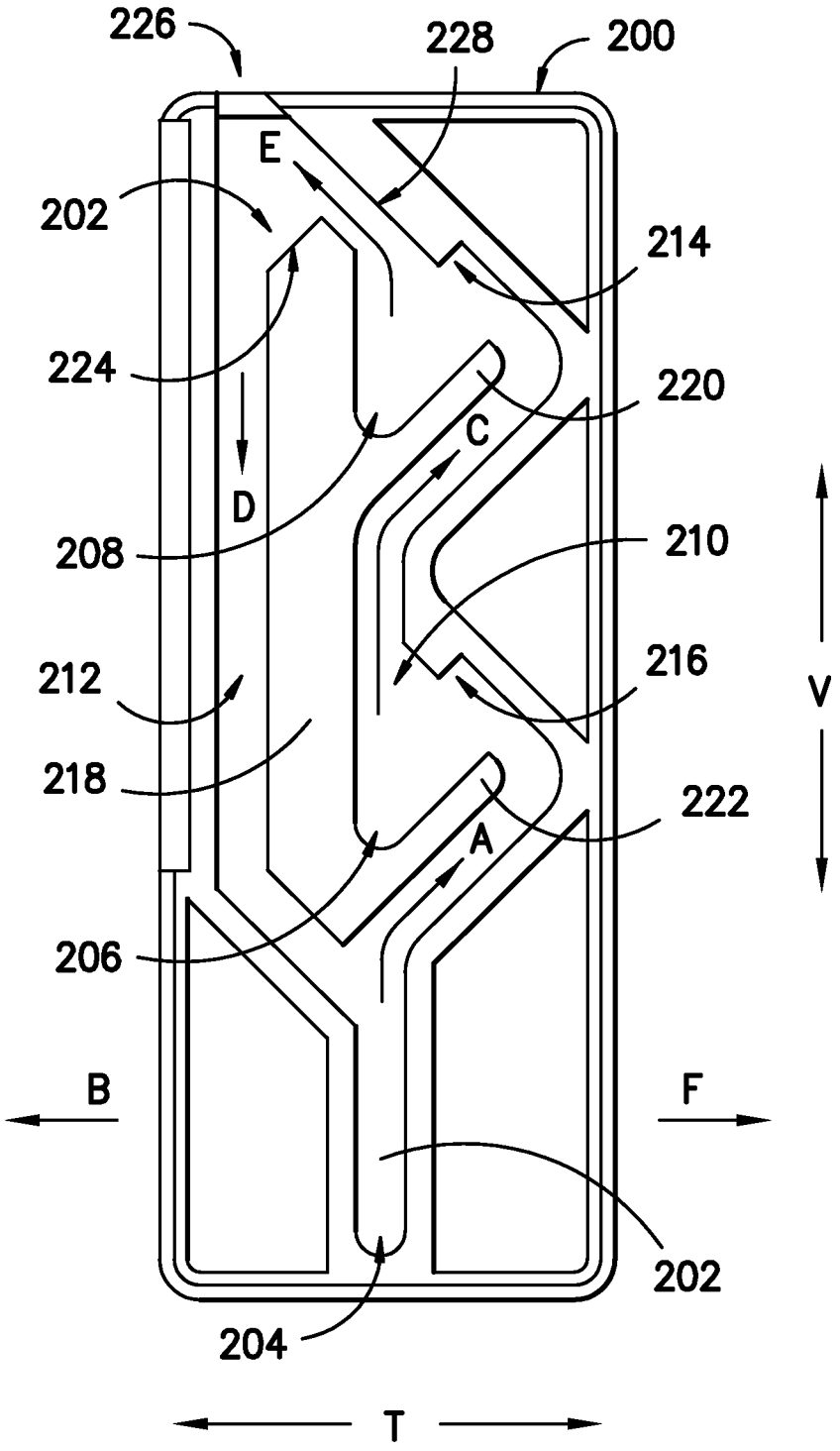
FIG. –9–

HEIGHT ADJUSTMENT MECHANISM FOR A RACK ASSEMBLY OF AN APPLIANCE

FIELD OF THE INVENTION

The subject matter of the present disclosure relates generally to a height adjustment mechanism for an appliance such as e.g., the rack assembly of a dishwashing appliance.

BACKGROUND OF THE INVENTION

A dishwashing appliance is typically provided with one or more rack assemblies into which various articles may be loaded for cleaning. The rack may include features such as e.g., tines that hold and orient the articles to receive sprays of wash and rinse fluids during the cleaning process. The articles to be cleaned may include a variety of dishes, cooking utensils, silverware, and other items.

The size of the articles can vary significantly. For example, glasses are available in a variety of different heights. Dishes are manufactured with various diameters between large and small. Pots used for cooking can have different depths.

In order to accommodate the larger articles, an upper rack assembly of a dishwashing appliance can be provided with features for height adjustment of the assembly. Such adjustability allows for movement of the upper rack assembly along a vertical direction. By moving or lifting the upper rack to a higher vertical position, larger articles can be accommodated in e.g., a lower rack assembly positioned beneath the upper rack assembly. Conversely, by lowering the upper rack to a lower vertical position, larger articles can be accommodated in e.g., the upper rack assembly.

Certain adjustment features have been proposed for providing height adjustability for a rack assembly. Typically, these features include multiple moving parts that may require the user to manipulate both the rack assembly and the adjustment features at the same time when lifting and/or lowering the rack assembly. For example, the user may be required to lower or lift the rack assembly while simultaneously depressing or squeezing a level or other aspect of the adjustment feature. For certain users, these adjustment features can be difficult to operate. Also, these adjustment features may not also allow for the removal of the rack assembly from the appliance. Removal may be desirable for repair or cleaning of the rack assembly.

Accordingly, an appliance having a height adjustable rack assembly would be useful. For example, a dishwashing appliance having an upper rack assembly that can be adjusted to different vertical positions would be useful. The ability to adjust the rack assembly between multiple different vertical positions would also be helpful. A mechanism that can be used to provide for height adjustment of a rack or other drawer like feature for a variety of different appliances including e.g., a dishwashing appliance would also be beneficial.

BRIEF DESCRIPTION OF THE INVENTION

The present invention provides for height adjustability of a rack assembly or other drawer-like feature of an appliance such as e.g., a dishwashing appliance. A support mechanism is provided that includes a track for controlling the movement of the rack between different vertical levels. Multiple different vertical levels can be configured. For certain embodiments, a user can adjust the height of the rack assembly by lifting and/or lowering the rack assembly directly and without a requirement of simultaneously depressing or squeezing the support mechanism or items thereon. Additional aspects and advantages of the invention will be set forth in part in the following description, or may be obvious from the description, or may be learned through practice of the invention.

In one exemplary embodiment, the present invention provides a dishwashing appliance defining lateral, transverse, and vertical directions. The dishwashing appliance includes a wash chamber having laterally opposing side walls. A rack assembly is configured for receipt of articles for washing. The rack assembly has opposing lateral sides. A plurality of bosses project from the rack assembly. A pair of slides is attached with the opposing lateral sides of the rack assembly. The slides are configured for sliding movement of the rack assembly relative to the wash chamber. A plurality of rack guides are supported by the slide and are positioned about opposing lateral sides of the rack assembly. Each of the rack guides includes a housing and a detent block received into the housing that is slidable along the transverse direction relative to the housing. The detent block defines a track into which a first boss from the plurality of bosses is slidably received. The track defines a plurality of vertically-spaced apart positions at which the first boss can be located so as to provide for vertical positioning of the rack assembly. The track is configured so that movement of the rack assembly along the vertical direction between the vertically-spaced apart positions causes the detent block to slide along the transverse direction relative to the housing.

In another exemplary embodiment, the present invention provides a support mechanism for a rack assembly of an appliance. The dishwashing appliance defines lateral, transverse, and vertical directions. The support mechanism includes a pair of slides for positioning the appliance on opposing lateral sides of the rack assembly and for moving the rack assembly in and out of the appliance. A plurality of rack guides are attached to the slides. Each rack guide includes a housing that defines a vertically-oriented first guide configured for sliding receipt of a first boss carried upon the rack assembly. A detent block is positioned within the housing and is slidable along the transverse direction relative to the housing. The detent block defines a track into which the first boss is slidably received. The track defines a plurality of vertically-spaced apart positions at which the first boss can be located so as to provide for vertical positioning of the rack assembly.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 8 is a perspective view of an exemplary detent block of the present invention while FIG. 9 is an elevation view of the same.

DETAILED DESCRIPTION OF THE INVENTION

Figure 1:
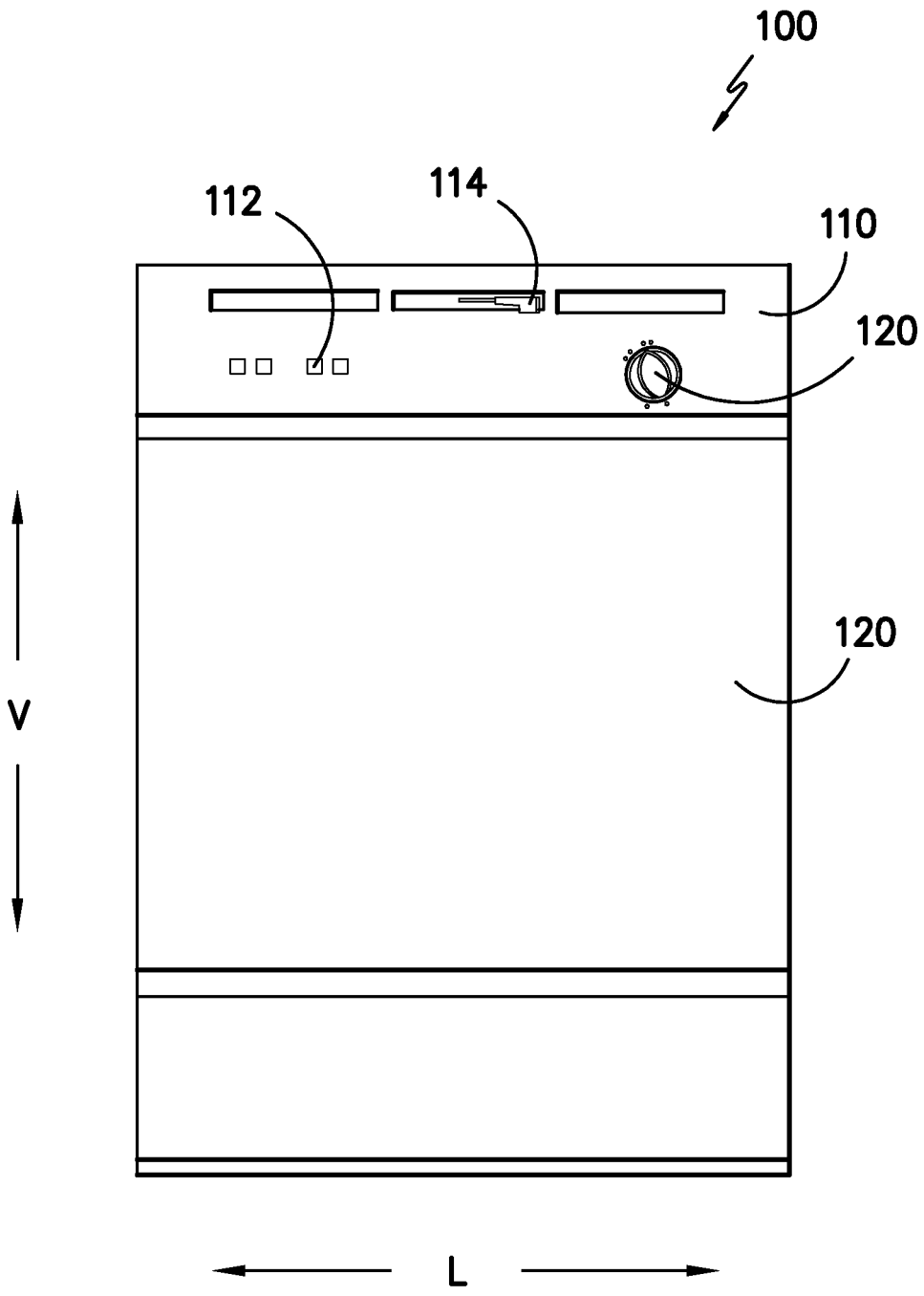
FIG. 1 provides a front view of an exemplary embodiment of a dishwasher of the present invention.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
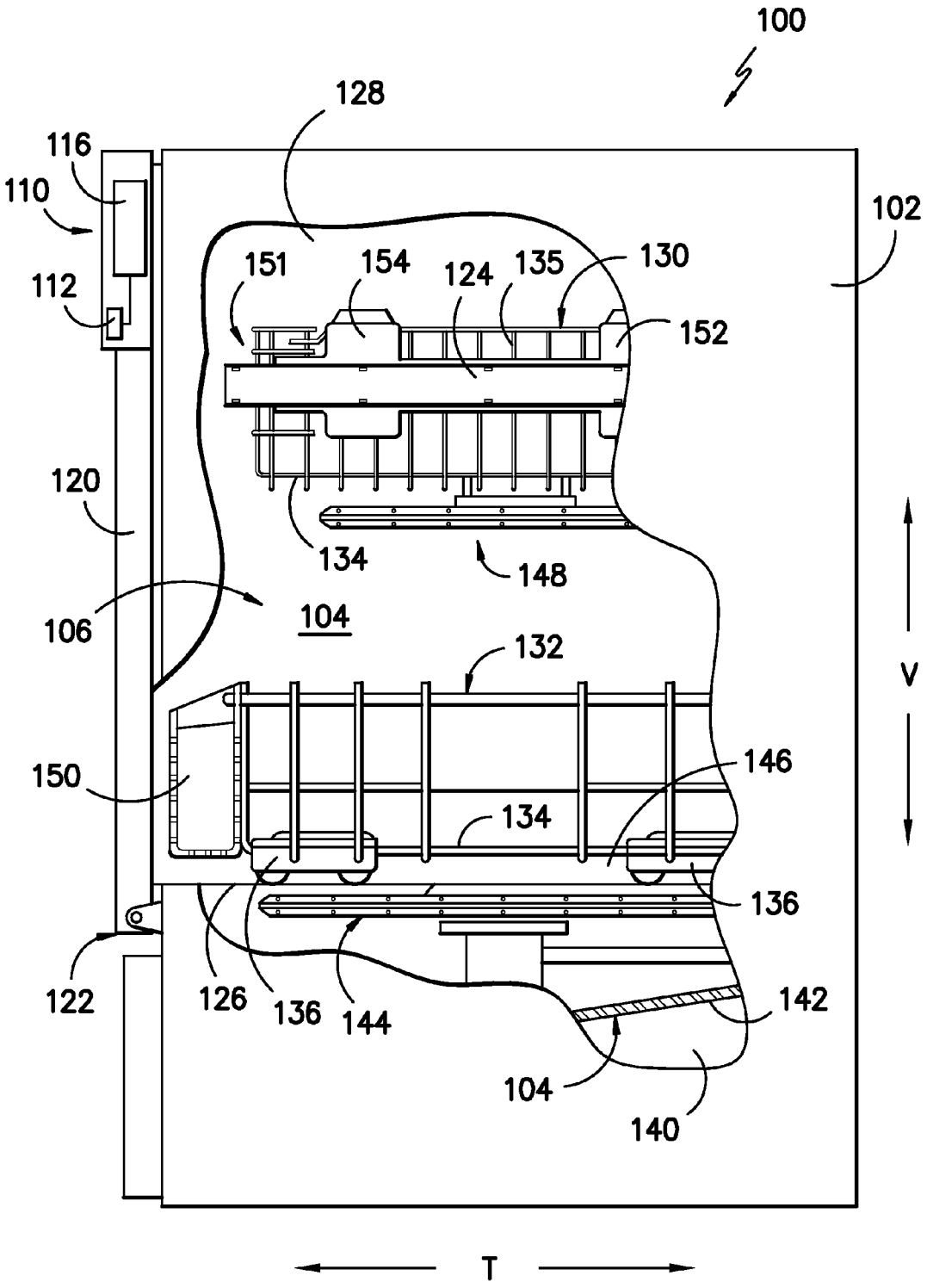
FIG. 2 provides a partial, cross-sectional side view of the exemplary embodiment of FIG. 1.

FIGS. 1 and 2 depict an exemplary domestic dishwasher 100 that may be configured in accordance with aspects of the present disclosure. For the particular embodiment of FIG. 1, the dishwasher 100 includes a cabinet 102 (or chassis) having a tub 104 therein that defines a wash chamber 106. The tub 104 includes a front opening (not shown) and a door 120 hinged at its bottom 122 for movement between a normally closed vertical position (shown in FIGS. 1 and 2), wherein the wash chamber 106 is sealed shut for washing operation, and a horizontal open position for loading and unloading of articles from the dishwasher. Latch 114 is used to lock and unlock door 120 for access to chamber 106.

Upper guide rails 124 are mounted on opposing tub side walls 128 to support and provide for movement for upper rack 130. Lower guides 126 are all positioned in opposing manner of the sides of chamber 106 and provide a ridge or shelf for roller assemblies 136 so as to support and provide for movement of lower rack 132. Each of the upper and lower racks 130, 132 is fabricated into lattice structures including a plurality of elongated members 134 and 135 that extend in lateral (L), transverse (T), and/or vertical (V) directions. Each rack 130, 132 is adapted for movement between an extended loading position (not shown) in which the rack is substantially positioned outside the wash chamber 106, and a retracted position (shown in FIGS. 1 and 2) in which the rack is located inside the wash chamber 106. This is facilitated by slide assembly 124 and roller assemblies 136 that carry racks 130 and 132, respectively. A silverware basket 150 may be removably attached to the lower rack 132 for placement of silverware, small utensils, and the like, that are too small to be accommodated by the upper and lower racks 130, 132.

The dishwasher 100 further includes a lower spray-arm assembly 144 that is rotatably mounted within a lower region 146 of the wash chamber 106 and above a tub sump portion 142 so as to rotate in relatively close proximity to the lower rack 132. A mid-level spray-arm assembly 148 is located in an upper region of the wash chamber 106 and may be located in close proximity to upper rack 130. Additionally, an upper spray or spray arm assembly (not shown) may be located above the upper rack 130.

The lower and mid-level spray-arm assemblies 144, 148 and the upper spray assembly are fed by a fluid circulation assembly for circulating water and dishwasher fluid in the tub 104. Portions of the fluid circulation assembly may be located in a machinery compartment 140 located below the bottom sump portion 142 of the tub 104, as generally recognized in the art. Each spray-arm assembly includes an arrangement of discharge ports or orifices for directing washing liquid onto dishes or other articles located in the upper and lower racks 130, 132, respectively. The arrangement of the discharge ports in at least the lower spray-arm assembly 144 provides a rotational force by virtue of washing fluid flowing through the discharge ports. The resultant rotation of the lower spray-arm assembly 144 provides coverage of dishes and other dishwasher contents with a washing spray.

The dishwasher 100 is further equipped with a controller 116 to regulate operation of the dishwasher 100. Controller 116 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

Controller 116 may be positioned in a variety of locations throughout dishwasher 100. In the illustrated embodiment, controller 116 may be located within a control panel area 110 of door 120 as shown. In such an embodiment, input/output ("I/O") signals may be routed between the control system and various operational components of dishwasher 100 along wiring harnesses that may be routed through the bottom 122 of door 120. Typically, the controller 116 includes a user interface panel 112 through which a user may select various operational features and modes and monitor progress of the dishwasher 100. In one embodiment, the user interface panel 112 may represent a general purpose I/O ("GPIO") device or functional block. In one embodiment, the user interface panel 112 may include input components, such as one or more of a variety of electrical, mechanical or electro-mechanical input devices including rotary dials, push buttons, and touch pads. The user interface 112 may include a display component, such as a digital or analog display device designed to provide operational feedback to a user. The user interface 112 may be in communication with the controller 116 via one or more signal lines or shared communication busses.

It should be appreciated that the invention is not limited to any particular style, model, or configuration of dishwasher. The exemplary embodiment depicted in FIGS. 1 and 2 is for illustrative purposes only. For example, different locations may be provided for a user interface 112, different configurations may be provided for racks 130, 132, and other differences may be applied as well.

Figure 3:
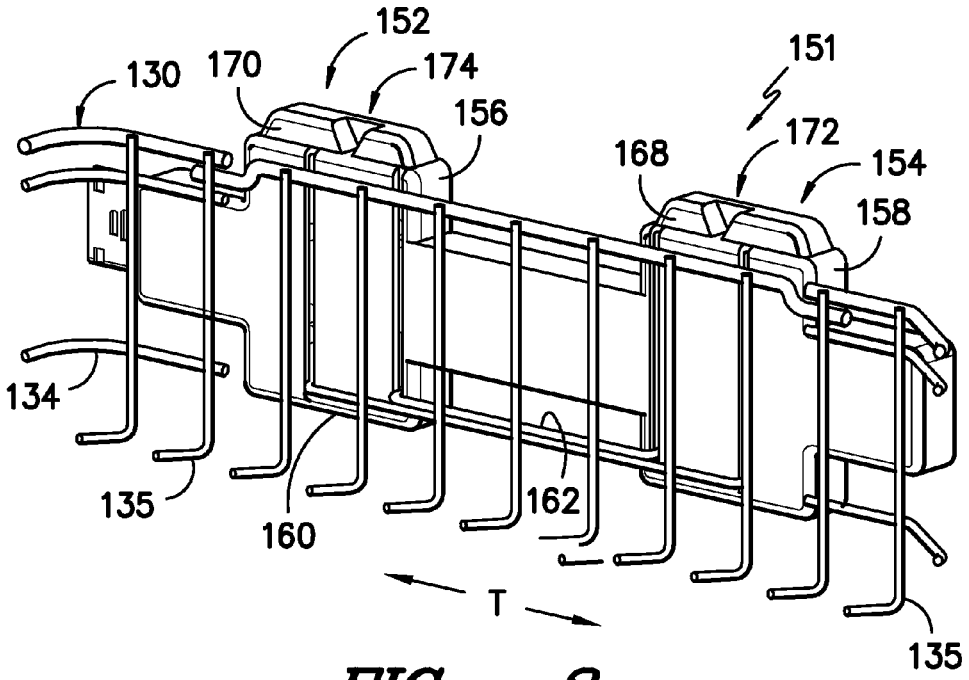
FIG. 3 provides a perspective view of the rack side of an exemplary support mechanism for the upper rack assembly of the dishwasher of FIGS. 1 and 2. Portions of the exemplary rack assembly have been removed for purposes of illustration.
Figure 4:
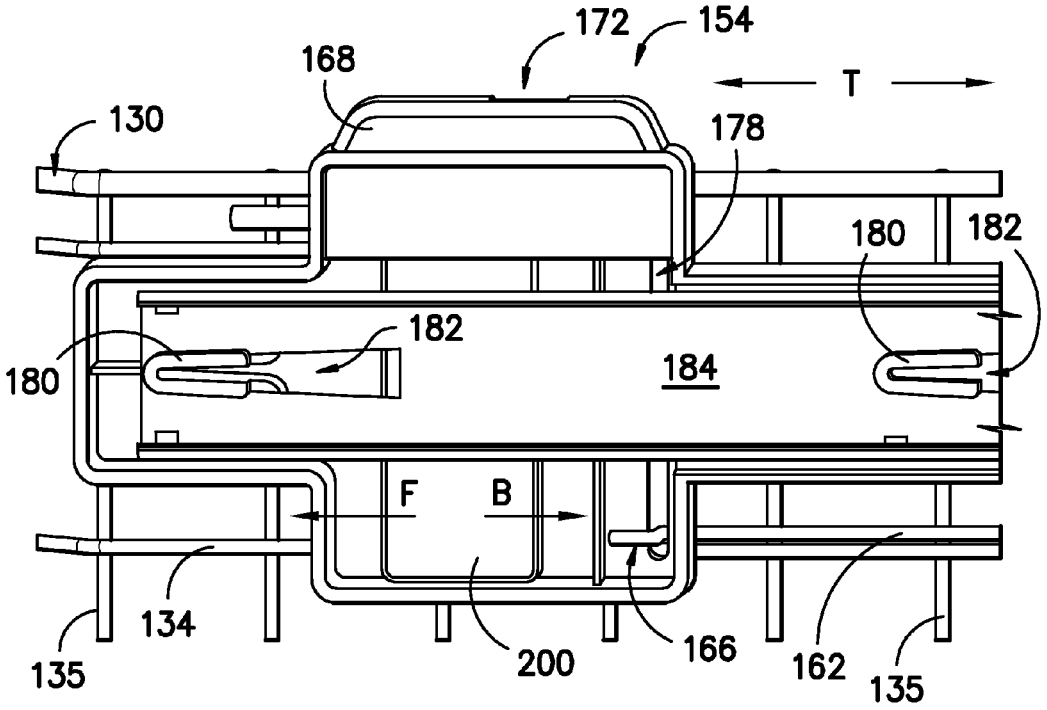
FIG. 4 illustrates a perspective of the wall side of a portion of the exemplary support mechanism of FIG. 3. Portions of the exemplary rack assembly have been removed for purposes of illustration.

FIG. 3 provides a perspective view of the rack side of an exemplary support mechanism 151 for the upper rack assembly 130 of the dishwasher 100 of FIGS. 1 and 2. FIG. 4 illustrates a perspective view from the position of side wall 128 of a portion of the exemplary support mechanism 151 of FIG. 3. While one support mechanism 151 will be shown and described in the figures, using the teachings disclosed herein it will be understood that a pair of support mechanisms 151 would be utilized on opposing lateral sides of upper rack assembly 130 to secure it to the laterally opposing side walls 128.

As shown, support mechanism 151 includes rack guides 152 and 154 that are spaced apart from each other along transverse direction T. Rack guide 152 includes a housing 156 with an attached latch 170 while rack guide 154 includes a housing 158 with an attached latch 168. Support mechanism 151 also includes a slide 184 positioned between support mechanism 151 and a tub side wall 128. Slide 184 forms part of an upper slide assembly 124 that is mounted to tub side wall 128. Projecting fingers 180 positioned on a side of support mechanism 151 are received into slots 182 formed in slide 184 to secure support mechanism 151 thereto.

Affixed to each lateral side of rack assembly 130 are a pair of elongated wire members 160 and 162 that extend along transverse direction T. In a manner as will be more fully described, rack assembly 130 it attached to support mechanisms 151 on each lateral side of rack assembly 130 such that it suspends from support mechanism 151. Furthermore, the vertical position or rack assembly 130 can be controlled and selected using support mechanisms 151.

Figure 5:
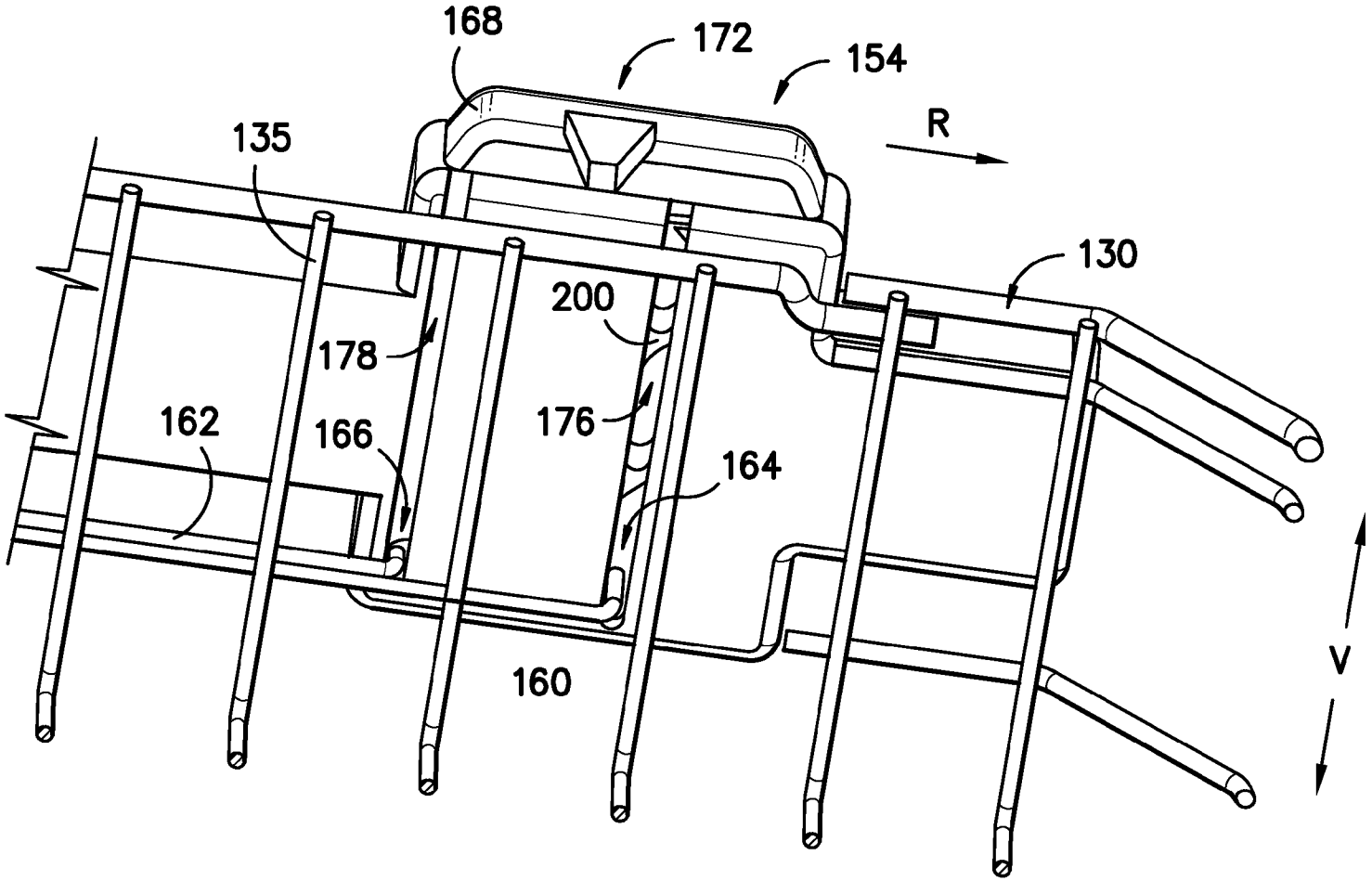
FIG. 5 is a close-up view of a portion of the exemplary support mechanism of FIG. 3 shown when the exemplary upper rack assembly is at its higher vertical position. Portions of the exemplary rack assembly have been removed for purposes of illustration.
Figure 6:
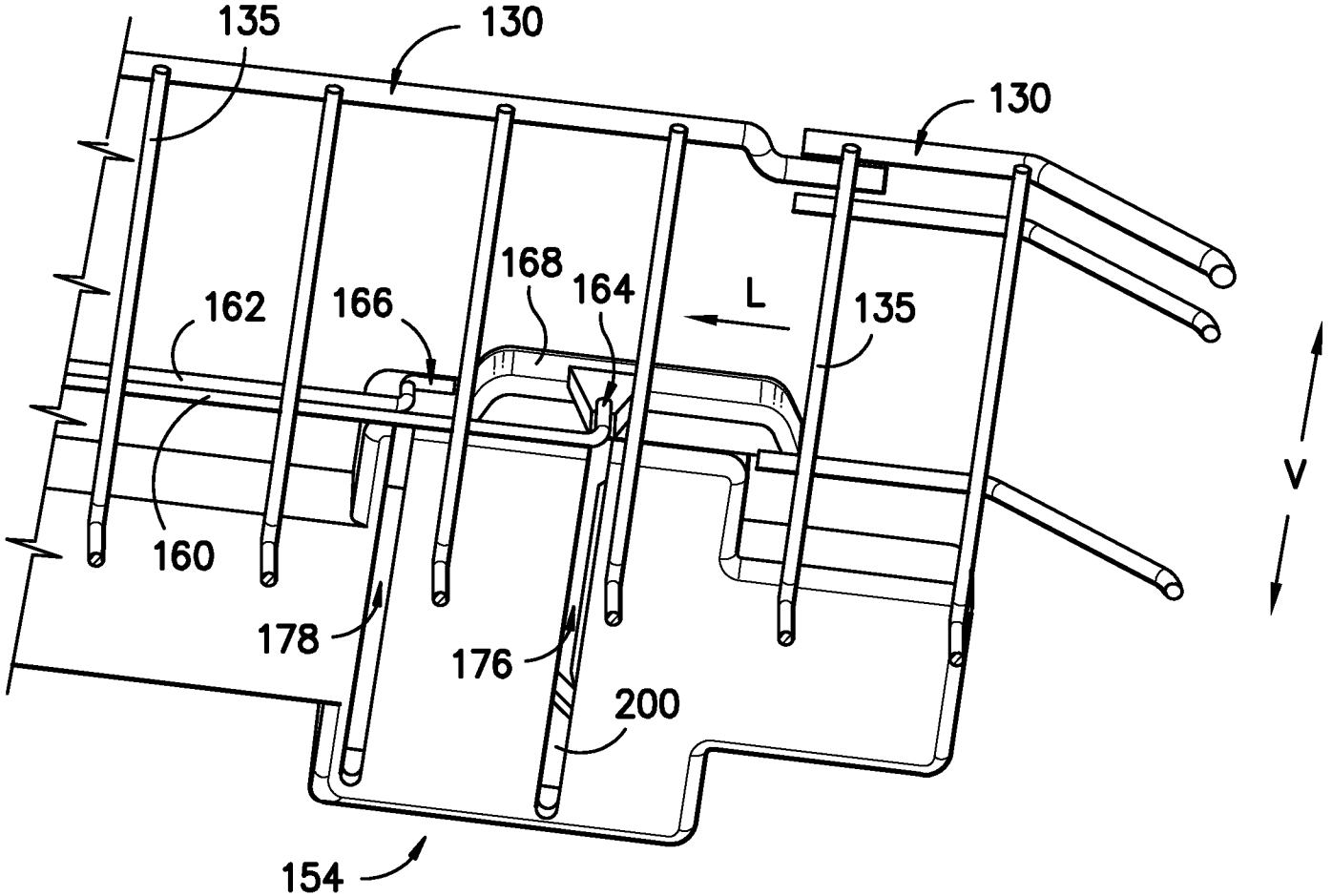
FIG. 6 is a close-up view of a portion of the exemplary support mechanism of FIG. 3 shown when the exemplary upper rack assembly is being removed from the support mechanism. Portions of the exemplary rack assembly have been removed for purposes of illustration.

Using rack guide 154 by way of example, FIGS. 5 and 6 illustrate a portion of upper rack assembly 130 as received into rack guide 154. FIG. 5 depicts rack assembly 130 in its lowest position while FIG. 6 depicts rack assembly 130 at a position where it can be removed from support mechanism 151. Support mechanism 151 can also be used to suspend rack assembly 130 at vertical positions located between that which is shown in FIGS. 5 and 6 as well.

As shown, first elongated wire member 160 provides first boss 164 a distal end that is received into a vertically-oriented first guide 176. Similarly, second elongated member 162 provides a second boss 166 at a distal end that is received into a vertically-oriented second guide 178. Each wire member 160 and 162 can slide within a respective guide 176 and 178 along vertical direction V such that rack assembly 130 can thereby be raised or lowered for height adjustment to e.g., accommodate various sizes of articles in wash chamber 106. Guide 176 and 178 are spaced apart from each other along the transverse direction T.

As stated, support mechanism 151 also allows for the removal of rack assembly 130 as well. More particularly, by sliding latch 168 in the direction of arrow R, latch opening 172 can be aligned with the top of first guide 176 and opens the top of second guide 178. As such, upper rack assembly 130 can now be completely removed. A reverse operation would apply for the installation or replacement of rack assembly 130. Sliding latch 168 along direction L blocks the top of guide 176 and 178 to prevent removal of rack assembly 130.

Figure 7:
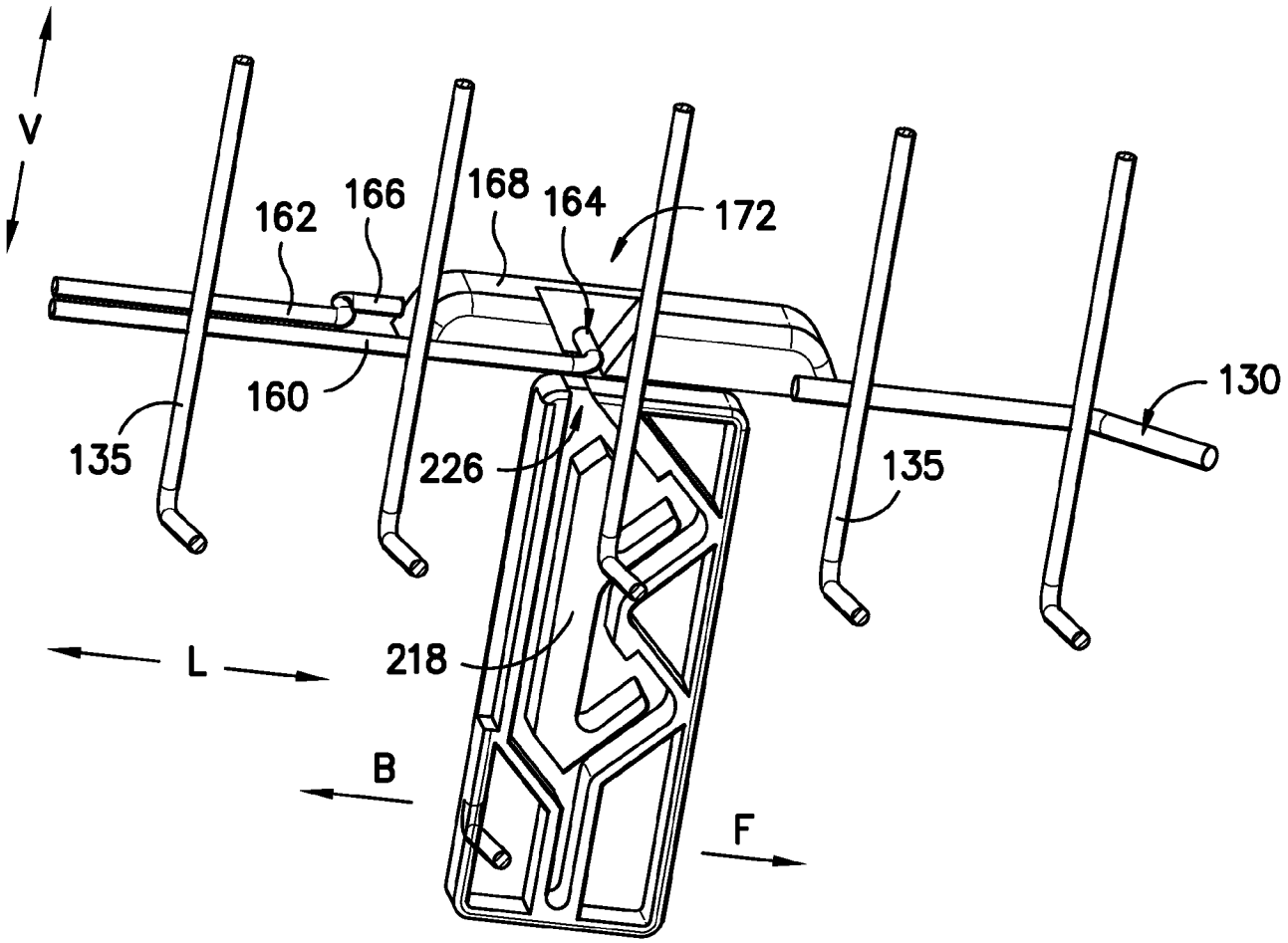
FIG. 7 is a perspective view of a portion of the exemplary support mechanism of FIG. 3, with portions of the exemplary support mechanism removed (e.g., the housing of a rack guide) for purposes of explanation of the operation of an exemplary detent block. Portions of the exemplary rack assembly have been removed for purposes of illustration.

Referring now to FIG. 7, housing 158 has been removed for purposes to reveal a detent block 200 that is received into housing 158. Detent block 200 moves freely within housing 158 along lateral direction L but is constrained from movement along vertical direction V. As shown by arrows F and R, detent block 200 can slide along lateral direction L toward the front of appliance 100 (arrow F) and slide along lateral direction L to the rear of appliance 100 (arrow R). This lateral movement is created due to the interaction between first boss 164 and certain features of detent block 200 as rack assembly 130 is raised or lowered by e.g., a user of the appliance.

Figure 8:
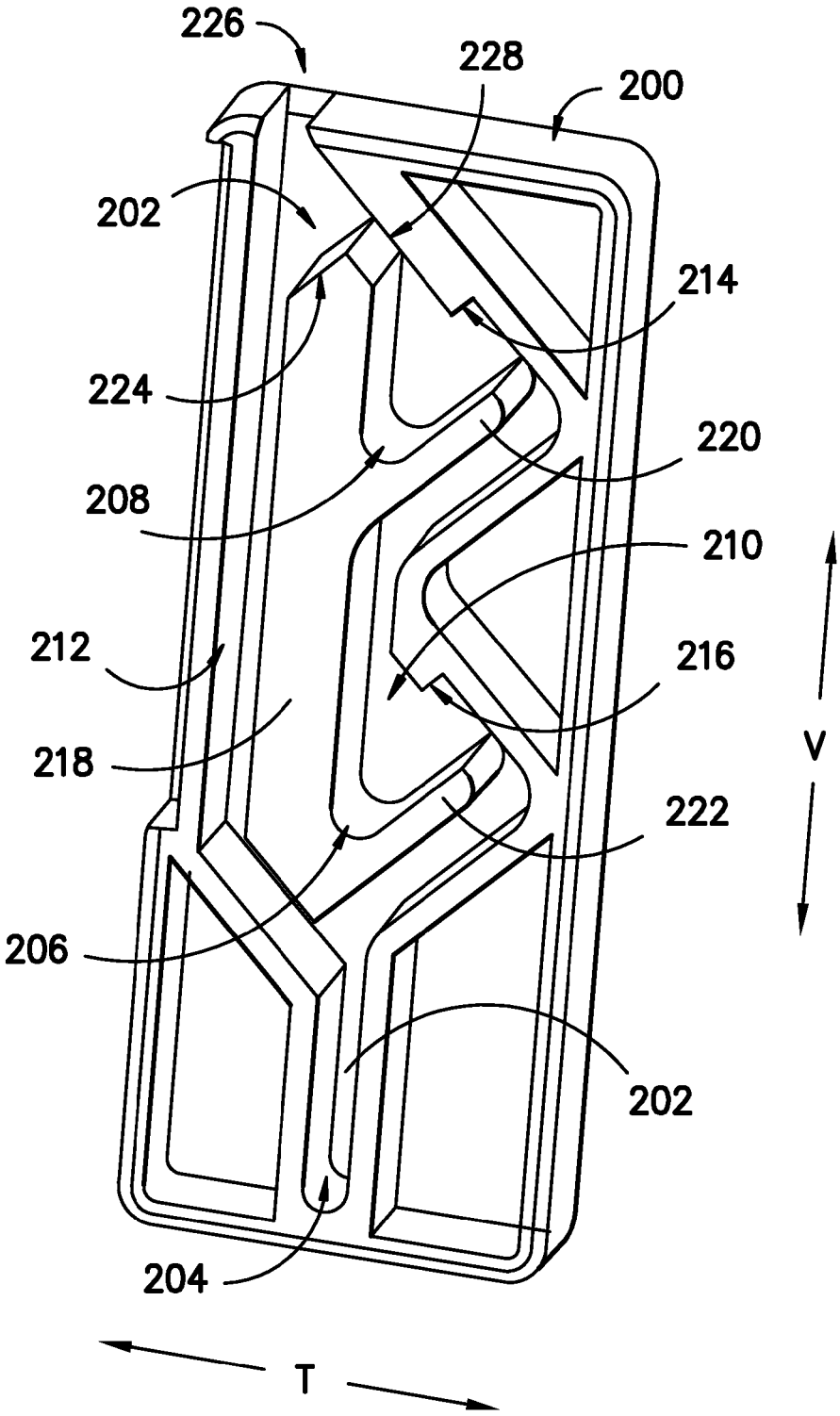

The features of detent block 200 are shown most clearly in FIGS. 8 and 9. More particularly, detent block 200 includes multiple projecting features that define a track 202 around which first boss 164 moves as upper rack assembly 130 is raised or lowered. Track 202 defines a first vertical position 204, second vertical position 206, and third vertical position 208. Positions 206 and 208 are provided by an island projection 218 that includes legs 220 and 222. Lifting channel 210 connects first vertical position 204, second vertical position 206, and third vertical position 208. Lowering channel 212 connects exit 226 and the top of lifting channel 210 with first vertical position 204.

Together, lifting channel 210 and lowering channel 212 create track 202 for the movement of first boss 164. For example, when first boss 164 is in first vertical position 204, rack assembly 130 is at its lowest height or lower vertical position within wash chamber 106. As indicated by arrow A, when a user lifts rack assembly 130, first boss 164 moves upward and impacts leg 222, which causes detent block 200 to shift in the direction of arrow B. As the user continues to lift rack assembly 130, first boss 164 will impact first stop 216. The user can then release rack assembly 130, which causes detent block 200 to shift in the direction of arrow F so that first boss 164 (and, therefore, rack assembly 130) will be supported at second vertical position 206.

If the user desires to position rack assembly 130 even higher, the user again lifts on rack assembly 130. As indicated by arrow C, first boss moves upward and impacts leg 220, which causes detent block 200 to again shift in the direction of arrow B. As the user continues to lift rack assembly 130, first boss 164 will impact second stop 214. The user can then release rack assembly 130, which causes detent block 200 to shift in the direction of arrow F so that first boss 164 (and, therefore rack assembly 130) will be supported at third vertical position 208.

Should the user desire to remove rack assembly 130 or to return to first vertical position 130 (the lowest), the user again lifts on rack assembly 130 so that first boss 164 will slide along ramp 228 and to reach exit 226 as shown by arrow E. If latch 168 is positioned with latch opening 172 adjacent to exit 226, then first boss 164 can be removed, which allows removal of upper rack assembly 130 as previously described. Alternatively, the user can release upper rack assembly 130, which will allow first boss 164 to move down lowering channel 212 and return to first vertical position 204 as indicated by arrow D.

As will be understood using the teachings disclosed herein, the structure and operation of rack guide 152 is similar to that described for rack guide 154. Furthermore, multiple rack guides can be used with slides 184 positioned on both lateral sides of upper rack assembly 130 to provide for its vertical positioning. For example, two rack guides could be used on each side of rack assembly 130 for a total of four. Other configurations can be used as well. Additionally, configuration of detent block 200 is also provided by way of example only. Other configurations having a different appearance may also be used to provide e.g., more or less vertical positions for rack assembly 130. Support mechanisms incorporating the rack guides described herein could also be used e.g., with racks, drawers, baskets, etc. for other appliances other than dishwashers as well.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwashing appliance defining lateral, transverse, and vertical directions, the dishwashing appliance comprising:

a wash chamber having laterally opposing side walls;

a rack assembly configured for receipt of articles for washing, said rack assembly having opposing lateral sides, a plurality of bosses projecting from said rack assembly;

a pair of slides attached with the opposing lateral sides of said rack assembly, said slides configured for sliding movement of said rack assembly relative to said wash chamber; and a plurality of rack guides supported by said slide and positioned about opposing lateral sides of said rack assembly, each of said rack guides comprising a housing;

a latch slidably attached to a top portion of said housing, said latch defining a latch opening; and a detent block received into said housing and slidable along the transverse direction relative to said housing, said detent block defining a track into which a first boss from said plurality of bosses is slidably received, the track defining a plurality of vertically-spaced apart positions at which the first boss can be located so as to provide for vertical positioning of said rack assembly, the track also defining a channel connecting the plurality of vertically-spaced apart positions and controlling the movement of said first boss between the vertically-spaced apart positions, the track also defining an exit connected with the channel so that the first boss may be removed from within said detent block by lifting said rack assembly along the vertical direction when the latch opening is aligned with the exit; wherein the track is configured so that movement of said rack assembly along the vertical direction between said vertically-spaced apart positions causes said detent block to slide along the transverse direction relative to said housing.

2. A dishwashing appliance as in claim 1, wherein the plurality of vertically-spaced apart positions comprises:

a first position;

a second position located vertically above said first position;

a third position located vertically above said second position; and wherein said track defines a channel connecting the first, second, and third positions for movement of the first boss therebetween.

3. A dishwashing appliance as in claim 2, further comprising a latch slidably attached to a top portion of said housing, said latch defining a latch opening;

wherein the track further defines an exit connected with the channel so that the first boss may be removed from within said detent block by lifting said rack assembly along the vertical direction when the latch opening is aligned with the exit.

4. A dishwashing appliance as in claim 1, wherein said housing comprises a vertically-oriented first guide through which the first boss is inserted so as to be received into the track.

5. A dishwashing appliance as in claim 4, wherein said housing comprises a vertically-oriented second guide through which a second boss from said plurality of bosses is inserted without being received into the track.

6. A dishwashing appliance as in claim 4, wherein the second boss is defined by an elongated member connected with said rack assembly and extending along the transverse direction.

7. A dishwashing appliance as in claim 1, wherein the first boss is defined by an elongated member connected with said rack assembly and extending along the transverse direction.

8. A dishwashing appliance as in claim 1, where each of said pair of slides comprises a plurality of slots, and further comprising a plurality of fingers projecting from said rack assembly and received into said slots so as to attach said pair of slides with said rack assembly.

9. A support mechanism for a rack assembly of an appliance, the dishwashing appliance defining lateral, transverse, and vertical directions, said support mechanism comprising:

a pair of slides for positioning in the appliance on opposing lateral sides of the rack assembly and configured for movement of the rack assembly in and out of the appliance;

a plurality of rack guides attached to said slides, each rack guide comprising:

a housing that defines a vertically-oriented first guide configured for sliding receipt of a first boss carried upon the rack assembly;

a detent block positioned within said housing and slidable along the transverse direction relative to said housing, said detent block defining a track into which the first boss is slidably received, the track defining a plurality of vertically-spaced apart positions at which the first boss can be located so as to provide for vertical positioning of the rack assembly; and a latch slidably attached to a top portion of said housing, said latch defining a latch opening;

wherein the track further defines an exit connected with the channel so that the first boss may be removed from within said detent block by lifting the rack assembly along the vertical direction when the latch opening is aligned with the exit.

10. A support mechanism for a rack assembly of an appliance as in claim 9, wherein said housing further defines a vertically-oriented second guide configured for sliding receipt of a second boss carried upon the rack assembly, the second guide spaced apart along the transverse direction from the first guide.

11. A support mechanism for a rack assembly of an appliance as in claim 9, wherein the track defines a channel connecting the plurality of vertically-spaced apart positions and controlling the movement of the first boss between the vertically-spaced apart positions.

12. A support mechanism for a rack assembly of an appliance as in claim 9, wherein the plurality of vertically-spaced apart positions comprises:

a first position;

a second position located vertically above said first position;

a third position located vertically above said second position; and wherein said track defines a channel connecting the first, second, and third positions for movement of the first boss therebetween.

13. A support mechanism for a rack assembly of an appliance as in claim 9, further comprising a latch slidably attached to a top portion of said housing, said latch defining a latch opening;

wherein the track further defines an exit connected with the channel so that the first boss may be removed from within said detent block by lifting the rack assembly along the vertical direction when the latch opening is aligned with the exit.

14. A support mechanism for a rack assembly of an appliance as in claim 9, wherein the first boss is defined by an elongated member connected with the rack assembly and extending along the transverse direction.

15. A support mechanism for a rack assembly of an appliance as in claim 9, wherein each of said pair of slides comprises a plurality of slots configured for receipt of a plurality of fingers projecting from the rack assembly.

* * * * *